US008651568B2

(12) United States Patent
Ancona, Jr. et al.

(10) Patent No.: US 8,651,568 B2
(45) Date of Patent: Feb. 18, 2014

(54) CHAIR WITH GUN HOLDER

(76) Inventors: Thomas Ancona, Jr., Evansville, IN (US); Troy D. Stuart, Evansville, IN (US); Ralph H. Davis, Arivaca, AZ (US); Michelle R. Davis, legal representative, Arivaca, AZ (US)

( * ) Notice: Subject to any disclaimer, the term of this patent is extended or adjusted under 35 U.S.C. 154(b) by 274 days.

(21) Appl. No.: 12/923,741

(22) Filed: Oct. 6, 2010

(65) Prior Publication Data

US 2012/0086242 A1 Apr. 12, 2012

(51) Int. Cl.
*A47C 7/62* (2006.01)

(52) U.S. Cl.
USPC ..... 297/188.04

(58) Field of Classification Search
USPC ..... 297/188.04, 188.06; 224/275, 560
See application file for complete search history.

(56) References Cited

U.S. PATENT DOCUMENTS

| | | | | | |
|---|---|---|---|---|---|
| 725,678 | A * | 4/1903 | Cullum | 248/290.1 |
| 1,264,278 | A * | 4/1918 | Cwiklinski | 297/59 |
| 2,535,564 | A * | 12/1950 | Campbell | 224/550 |
| 2,706,517 | A * | 4/1955 | Dexter et al. | 297/188.2 |
| 3,044,828 | A * | 7/1962 | Fowler | 297/188.06 |
| 3,167,182 | A * | 1/1965 | Calvin | 211/64 |
| 3,326,385 | A * | 6/1967 | Pinkerton et al. | 211/4 |
| 5,961,181 | A * | 10/1999 | Salehi et al. | 297/188.04 |
| 6,450,378 | B1 * | 9/2002 | Miller | 224/275 |

* cited by examiner

*Primary Examiner* — Peter Brown
(74) *Attorney, Agent, or Firm* — Bowers Harrison, LLP; Katherine N. Worman, Esq.

(57) ABSTRACT

The present invention relates to holding rack for a rifle comprising of a dining chair, a first hook attached to the backrest and extending rearward, and a second hook attached to the stretcher and offset laterally from the first hook, with both hooks being covered with a soft material to protect the rifle. The preferred embodiment of the present invention includes a dining chair having a seat, a strecher and a backrest, a first hook attached to the back rest and extending rearward therefrom; and a second hook attached to the stretcher and extending rearward therefrom, the second hook offset laterally from the first hook; whereby the rifle is engaged in suspension by the first hook through its trigger guard and its barrel rests against the second hook. Both the first and second hooks are covered with a soft material to protect the rifle. The spacing and angle of the hook themselves and the angle at which the hooks attach to the chair being critical for the rifle to rest safely. The chair legs preferable have a glide or cap attached to them with said glide or cap comprised of heavy duty specially formulated k-resin designed for military use, and the angle of the back legs of said chair is critical to stabilize weight when a rifle is mounted into said apparatus.

2 Claims, 1 Drawing Sheet

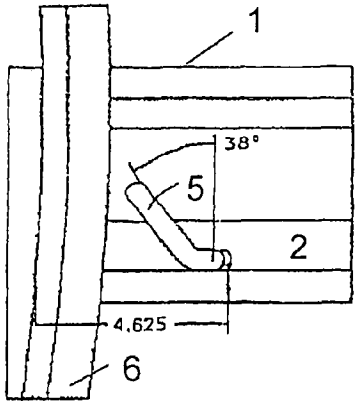
Figure 3
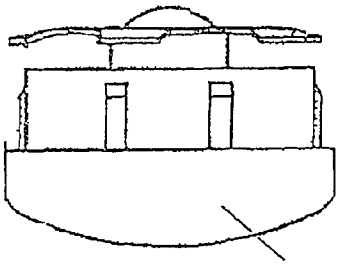
Figure 4
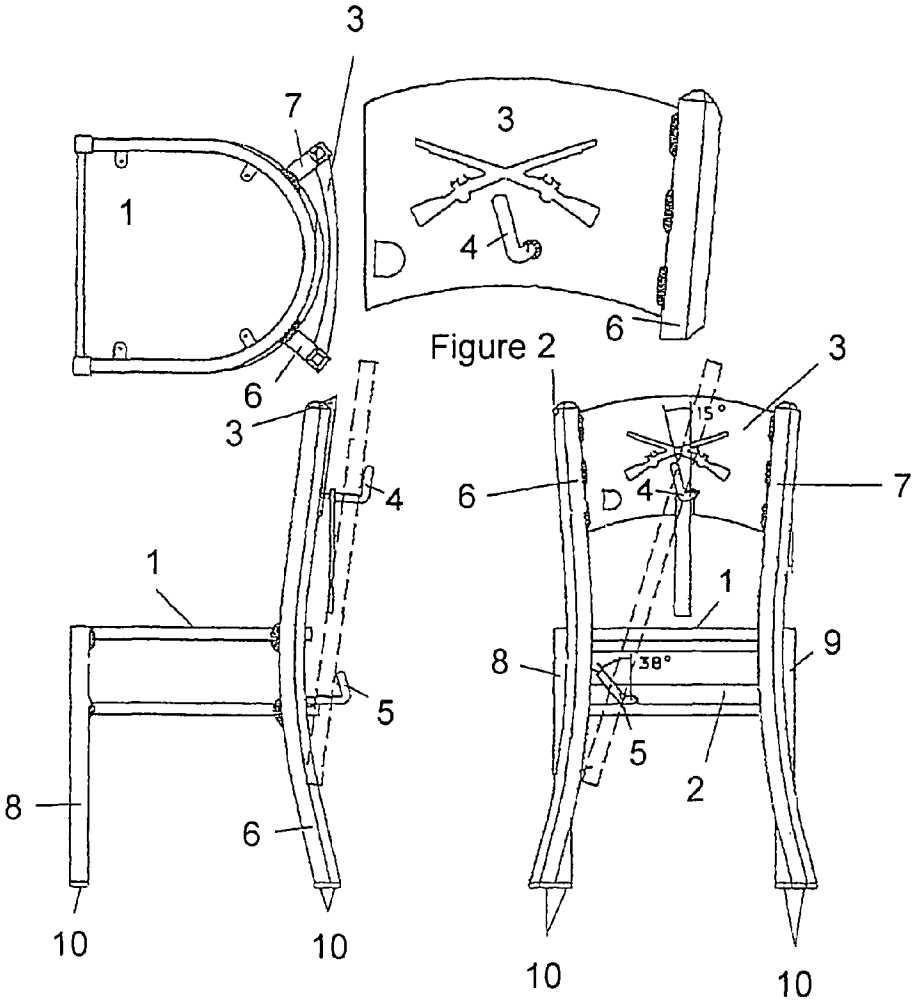
Figure 2
Figure 1

CHAIR WITH GUN HOLDER

CROSS REFERENCES TO RELATED APPLICATIONS none.

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

This invention relates to a holding rack for a rifle comprising of a dining chair, a hook attached to the backrest and extending rearward, and a hook attached to the stretcher and offset laterally from the first hook, with both hooks being covered with a soft material to protect the rifle.

2. Background Information

The use of various gun supports and gun rests for holding rifles and guns is known in the prior art. However, none of these devices or apparatuses take into consideration military use and the fact that soldiers who carry a rifle on a continuous basis need to store the rifle while they are seated and performing other tasks such as sitting or eating. Typically, rifles are laid on the floor or table or propped up against the table or wall which can result in hazardous conditions. Thus, there is a need for a holding rack comprised of a dining chair with rearward extending hooks to hold a rifle while an individual is in the seated position.

A prior art search uncovered the following prior art:

U.S. Pat. No. 5,375,905 Dec. 27, 1994 Flitter
U.S. Pat. No. 2,535,564 Dec. 26, 1950 Campbell
U.S. Pat. No. 3,022,898 Jul. 15, 1960 Loeb
U.S. Pat. No. 6,450,378 Sep. 17, 2002 Miller
U.S. Pat. No. 5,915,562 Jul. 29, 1999 Hancock
U.S. Pat. No. 3,294,247 Dec. 27, 1966 Norrington
U.S. Pat. No. 5,836,646 Nov. 17, 1998 Salehi
U.S. Pat. No. 0,847,318 Mar. 19, 1907 Cope
U.S. Pat. No. 0,725,678 Apr. 21, 1903 Cullum However, none of the above-referenced registrations apply to holding racks comprised of hooks that are integral with the chair for the purposes of holding a firearm or rifle.

As will be seen from the subsequent description, the preferred embodiments of the present invention overcome the above problems and difficulties of the prior art.

SUMMARY OF THE INVENTION

Soldiers and various other individuals are required to carry rifles, such as the M16 A1, A2, and M4, with them at all times even when they are seated and performing other tasks. In these situations without a proper place to store or an apparatus to hold the rifles, the rifles are either laid on the floor or a table or propped up against the wall, a table, or something else which can result in a potentially hazardous situation.

The present invention relates to a holding rack for a rifle comprising of a dining chair, a hook attached to the backrest and extending rearward, and a second hook attached to the stretcher and offset laterally from the first hook, with both hooks being covered with a soft material to protect the rifle. The preferred embodiment includes a dining chair, preferably metal and preferably with back legs angled outwards at five (5) degrees as said angle of the back legs being critical for weight stabilization when holding a rifle, and attached to and integral with said dining chair are two angled hooks covered with a soft material, with one being located at the base of the back rest and one located on the stretcher, with the spacing and angle of the hooks being critical.

BRIEF DESCRIPTION OF THE DRAWINGS

FIG. 1 illustrates the back view, the side view, and the top view of the present invention, a holding rack for a rifle comprising of a dining chair, a hook attached to the backrest and extending rearward, and a second hook attached to the stretcher and offset laterally from the first hook, with both hooks being covered with a soft material to protect the rifle.

FIG. 2 illustrates the back view focusing on the first hook attached to the backrest and extending rearward.

FIG. 3 illustrates the back view focusing on the second hook attached to the stretcher, extending rearward, and offset laterally from the first hook.

FIG. 4 illustrates a preferred embodiment of the chair legs, having a glide or cap attached to said chair legs with said glide or cap comprised of heavy duty specially formulated k-resin designed for military use.

DESCRIPTION OF THE PREFERRED EMBODIMENTS

In accordance with the present invention, a dining chair with gun holder is disclosed. The dining chair with gun holder is directed to enable an individual carrying a rifle such as an M16 A1, A2, and M4, to store said gun or rifle on said chair while said individual is seated.

FIG. 1 illustrates the preferred embodiment of the dining chair with gun holder. The apparatus generally includes a dining chair having a seat 1, a stretcher 2 and a backrest 3; a first hook 4 attached to the backrest 3 and extending rearward thereform; and a second hook 5 attached to the stretcher 2 and extending rearward therefrom, the second hook 5 offset laterally from the first hook 4; whereby the rifle is engaged in suspension by the first hook 4 through its trigger guard and its barrel rests against the second hook 5. Both the first 4 and second hooks 5 are covered with a soft material to protect the rifle.

The dining chair is preferably comprised of a metal substance. As shown in FIG. 1, the back legs 6 of said chair are angled outwards at a preferred angle of five (5) degrees to stabilize the weight on the back of said chair when a rifle is mounted in the holder. The legs of said chair 6, 7, 8, and 9 also preferably have glide or cap 10 attached to them with said glide or cap 10 comprised of heavy duty specially formulated k-resin designed for military use. Both the first 4 and second hooks 5 are comprised of a metal substance, preferably measuring ⅜ inch in diameter. Both the second 5 and first 4 hooks are bent at an angle of preferably 95 degree.

As shown in FIG. 1, in the back view, and in FIG. 2, said first hook 4 is attached to said chair on the back rest 3, preferably 6.5 inches from the right side of said chair and preferably 26.185 inches from the bottom of the chair to the location of the first hook 4. Said first hook 4 is welded to the back rest 5 of said chair at an angle, preferably of 15 degrees, rather than being attached perpendicular to the back rest 5. When a rifle is placed into said holding rack at said first hook 4, said first hook 4 will slide into the trigger guard, holding said rifle.

Also as shown in FIG. 1, in the back view, and FIG. 3, said second hook 5 is attached to said chair on the stretcher 2, preferably 4.625 inches from the left leg of said chair 7 and preferably 11.750 inches from the bottom of the chair leg 7 to the location of the second hook 5. This will result in the second hook 5 being offset laterally to the right with the first hook 4 and will result in said rifle being held at an angle when placed in the holding rack. Said second hook 5 is welded to said stretcher 2 of said chair at an angle, preferably of 38 degrees, rather than being attached perpendicular to the back stretcher 2. When a rifle is placed into said apparatus at said second hook 5, the barrel portion of said rifle will be held.

An alternative embodiment of the location of said first hook 4 and second hook 5 would result in a lateral offset to the left and a change in the direction of the angle at which the rifle is being held.

Although the description above contains many specifications, these should not be construed as limiting the scope of the invention but as merely providing illustrations of some of the presently preferred embodiments of this invention.

We claim:

1. A holding rack for a rifle, comprising:

a chair having a seat, at least two rear legs, a stretcher which connects the two rear legs to each other and is located below the seat, and a backrest;

a first hook attached to the backrest and extending rearward therefrom at an angle in a lateral direction; and a second hook attached to the stretcher and extending rearward therefrom at an angle in a lateral direction, the second hook offset laterally from the first hook;

whereby the first hook is adapted to engage a trigger guard for a rifle and the second hook is adapted to support a barrel of a rifle.

2. The holding rack of claim 1, wherein the first hook and the second hook are covered with a soft material to protect a rifle.

* * * * *